US010138751B2

(12) United States Patent
Hill et al.

(10) Patent No.: US 10,138,751 B2
(45) Date of Patent: Nov. 27, 2018

(54) SEGMENTED SEAL FOR A GAS TURBINE ENGINE

(71) Applicant: UNITED TECHNOLOGIES CORPORATION, Hartford, CT (US)

(72) Inventors: James D. Hill, Tolland, CT (US); Gabriel L. Suciu, Glastonbury, CT (US); Ioannis Alvanos, West Springfield, MA (US); Brian D. Merry, Andover, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 446 days.

(21) Appl. No.: 14/733,984

(22) PCT Filed: Dec. 19, 2013

(86) PCT No.: PCT/US2013/076347
§ 371 (c)(1),
(2) Date: Jun. 9, 2015

(87) PCT Pub. No.: WO2014/100316
PCT Pub. Date: Jun. 26, 2014

(65) Prior Publication Data

US 2015/0377052 A1 Dec. 31, 2015

Related U.S. Application Data

(60) Provisional application No. 61/739,221, filed on Dec. 19, 2012, provisional application No. 61/835,034, filed on Jun. 14, 2013.

(51) Int. Cl.
*F01D 5/00* (2006.01)
*F01D 11/12* (2006.01)
(Continued)

(52) U.S. Cl.
CPC ..... *F01D 11/122* (2013.01); *F01D 5/06* (2013.01); *F01D 11/001* (2013.01);
(Continued)

(58) Field of Classification Search
CPC ..... F01D 11/122
See application file for complete search history.

(56) References Cited

U.S. PATENT DOCUMENTS 3,733,146 A 5/1973 Smith et al.
4,094,673 A * 6/1978 Erickson ..... B22F 3/002 415/174.4

(Continued)

FOREIGN PATENT DOCUMENTS

EP 2535523 A2 12/2012
EP 2639409 A2 9/2013

OTHER PUBLICATIONS

Extended European Search Report and Application No. EP 13 86 5215 dated Dec. 15, 2015.

(Continued)

*Primary Examiner* — Igor Kershteyn
*Assistant Examiner* — Jason Fountain
(74) *Attorney, Agent, or Firm* — Carlson, Gaskey & Olds

(57) ABSTRACT

A seal segment according to an exemplary aspect of the present disclosure includes, among other things, a first axial wall, a second axial wall radially spaced from the first axial wall and a radially outer wall that interconnects the first axial wall and the second axial wall. At least one curved member is radially inwardly offset from the radially outer wall and extending between the first and second axial walls.

20 Claims, 3 Drawing Sheets

(51) Int. Cl.
*F01D 11/00* (2006.01)
*F01D 5/06* (2006.01)

(52) U.S. Cl.
CPC ..... *F01D 11/008* (2013.01); *F05D 2220/32* (2013.01); *F05D 2240/24* (2013.01); *F05D 2240/55* (2013.01); *F05D 2250/71* (2013.01)

(56) References Cited

U.S. PATENT DOCUMENTS 4,470,757 A 9/1984 Vollinger
4,645,424 A 2/1987 Peters
4,884,950 A 12/1989 Brodell et al.
5,785,775 A * 7/1998 Smashey ..... B23K 9/0026 148/527
5,833,244 A 11/1998 Salt et al.
6,655,920 B2 12/2003 Beutin et al.
7,121,791 B2 10/2006 Friedl et al.
7,918,643 B2 * 4/2011 Weaver ..... F01D 11/001 277/347
8,221,062 B2 7/2012 Liotta et al.
8,240,980 B1 8/2012 Liang
8,240,986 B1 8/2012 Ebert
8,246,299 B2 8/2012 Razzell et al.
8,388,309 B2 3/2013 Marra et al.
8,616,850 B2 * 12/2013 Ward ..... F01D 5/3007 416/204 A
2009/0324394 A1 12/2009 Weaver
2012/0321437 A1 * 12/2012 Hafner ..... F01D 11/001 415/1

OTHER PUBLICATIONS

International Preliminary Report on Patentability for PCT Application No. PCT/US2013/076347, dated Jul. 2, 2015.
International Search Report and Written Opinion of the International Searching Authority for International application No. PCT/US2013/07637 dated Mar. 31, 2014.

* cited by examiner

SEGMENTED SEAL FOR A GAS TURBINE ENGINE

BACKGROUND

This disclosure relates to a gas turbine engine, and more particularly to a segmented seal that can be incorporated into a gas turbine engine.

Gas turbine engines typically include at least a compressor section, a combustor section, and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

The compressor section and the turbine section may each include alternating rows of rotor and stator assemblies. The rotor assemblies carry rotating blades that create or extract energy (in the form of pressure) from the core airflow that is communicated through the gas turbine engine. The stator assemblies include stationary structures called stators that direct the core airflow to the blades to either add or extract energy.

It may become necessary to seal cavities that extend between adjacent rotor assemblies and stator assemblies. Known annular seals used for this purpose may allow recirculation of the core airflow between the blades of the rotor assemblies.

SUMMARY

A seal segment according to an exemplary aspect of the present disclosure includes, among other things, a first axial wall, a second axial wall radially spaced from the first axial wall and a radially outer wall that interconnects the first axial wall and the second axial wall. At least one curved member is radially inwardly offset from the radially outer wall and extending between the first and second axial walls.

In a further non-limiting embodiment of the foregoing seal segment, the seal segment is part of a gas turbine engine.

In a further non-limiting embodiment of the foregoing seal segments, the seal segment is part of a low pressure turbine of a turbine section.

In a further non-limiting embodiment of any of the foregoing seal segments, the at least one curved member is curved in a direction toward the radially outer wall.

In a further non-limiting embodiment of any of the foregoing seal segments, the at least one curved member is curved in a direction away from the radially outer wall.

In a further non-limiting embodiment of any of the foregoing seal segments, the radially outer wall includes a groove that extends between the first axial wall and the second axial wall.

In a further non-limiting embodiment of any of the foregoing seal segments, the groove is configured to receive a seal.

In a further non-limiting embodiment of any of the foregoing seal segments, the at least one curved member extends between the first axial wall and the second axial wall.

In a further non-limiting embodiment of any of the foregoing seal segments, the at least one curved member extends between flanges that protrude from the first axial wall and the second axial wall.

In a further non-limiting embodiment of any of the foregoing seal segments, the at least one curved member conveys an axial force against an adjacent structure of the seal segment.

In a further non-limiting embodiment of any of the foregoing seal segments, the at least one curved member is non-perpendicular relative to the first axial wall and the second axial wall.

In a further non-limiting embodiment of any of the foregoing seal segments, at least one seal extends from the radially outer wall.

A turbine section according to an exemplary aspect of the present disclosure includes, among other things, a first rotor disk, a second rotor disk and a seal segment axially intermediate of the first rotor disk and the second rotors disk. The seal segment has a curved member that is configured to convey an axial force against at least one of the first rotor disk and the second rotor disk.

In a further non-limiting embodiment of the foregoing turbine section, a stator assembly is radially outward of the seal segment.

In a further non-limiting embodiment of either of the foregoing turbine sections, the stator assembly includes an abradable seal that interfaces with a seal of the seal segment.

In a further non-limiting embodiment of any of the foregoing seal segments, the seal segment includes a first axial wall and a second axial wall radially spaced from the first axial wall. A radially outer wall interconnects the first axial wall and the second axial wall, The curved member is radially inwardly offset from the radially outer wall and extends between the first and second axial walls.

A gas turbine engine according to an exemplary aspect of the present disclosure includes, among other things, a first rotor assembly, a second rotor assembly and a stator assembly axially intermediate of the first rotor assembly and the second rotor assembly. A plurality of seal segments are disposed in a cavity defined between the first rotor assembly and the second rotor assembly. Each of the plurality of seal segments includes a first axial wall and a second axial wall spaced from the first axial wall. A radially outer wall interconnects the first axial wall and the second axial wall. At least one curved member is radially offset from the radially outer wall.

In a further non-limiting embodiment of the foregoing gas turbine engine, each of the first axial wall and the second axial wall include a flange that abuts a ledge of a rotor disk of the first rotor assembly and the second rotor assembly.

In a further non-limiting embodiment of either of the foregoing gas turbine engines, the at least one curved member is under an axial compressive force between the flanges.

In a further non-limiting embodiment of any of the foregoing gas turbine engines, each of the plurality of seal segments include at least one truss member that extends between the radially outer wall and the at least one curved member.

The various features and advantages of this disclosure will become apparent to those skilled in the art from the following detailed description. The drawings that accompany the detailed description can be briefly described as follows.

DETAILED DESCRIPTION

This disclosure relates to seal segments for annularly sealing between rotating and stationary structures of a gas turbine engine. As detailed herein, among other features, the seal segments of this disclosure reduce stresses and loading and shield surrounding hardware from heat by reducing gas ingestion between a core flow path and a secondary cooling flow path of the gas turbine engine.

Figure 1:
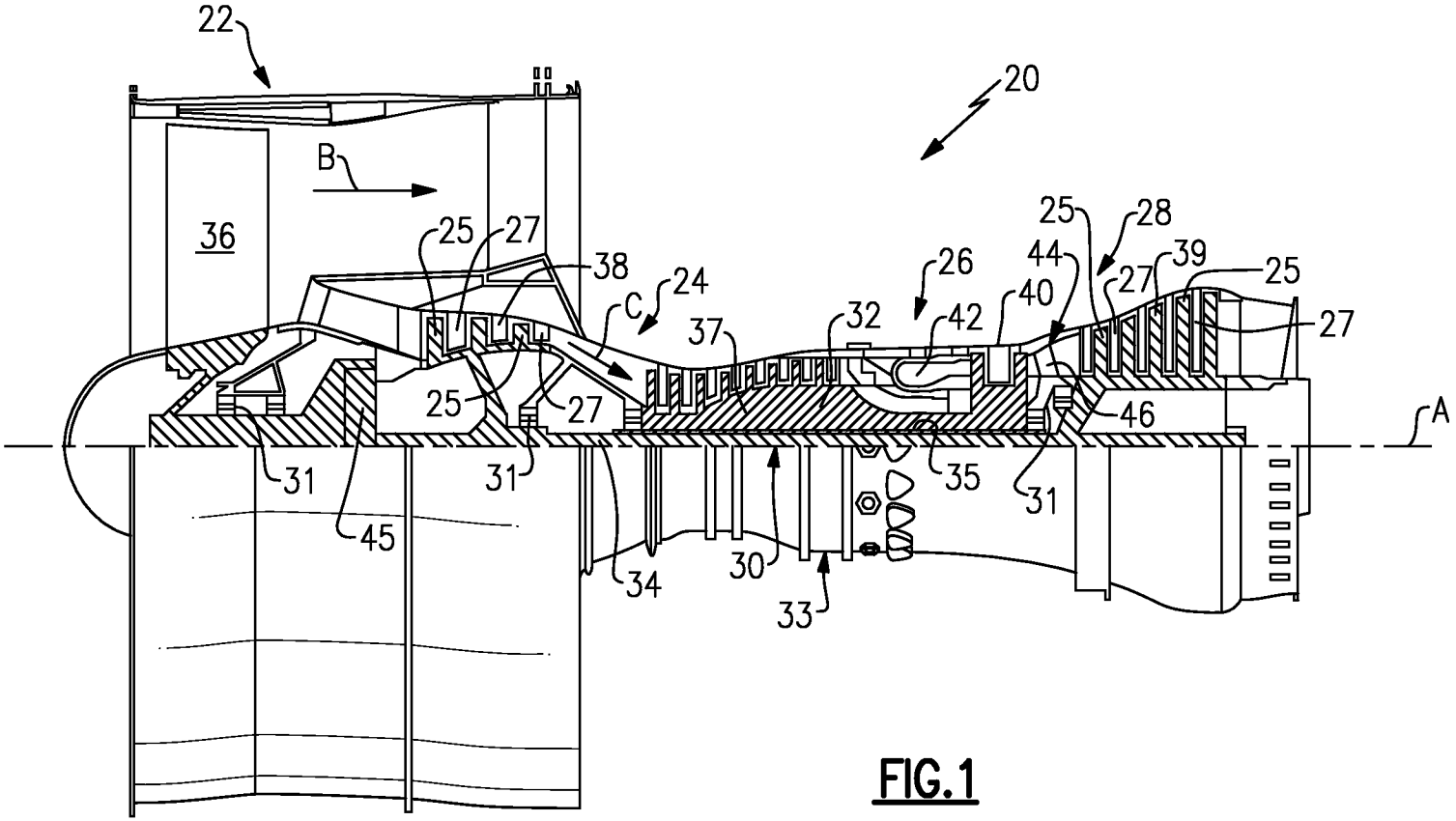
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems for features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only exemplary of one embodiment of a geared architecture engine and that the present disclosure is applicable to other gas turbine engines, including direct drive turbofans.

In this embodiment of the exemplary gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[\text{Tram}^\circ\ \text{R})/(518.7^\circ\ \text{R})]^{0.5}$. The Low Corrected Fan Tip Speed according to one non-limiting embodiment of the example gas turbine engine 20 is less than about 1150 fps (351 m/s).

The compressor section 24 and the turbine section 28 may include alternating rows of rotor assemblies and stator assemblies (shown schematically) that carry airfoils. For example, rotor assemblies carry a plurality of rotating blades 25, while stator assemblies carry stationary stators 27 (or vanes) that extend into the core flow path C to influence the hot combustion gases. The blades 25 create or extract energy (in the form of pressure) from the core airflow that is communicated through the gas turbine engine 20 along the core flow path C. The stators 27 direct the core airflow to the blades 25 to either add or extract energy.

Figure 2:
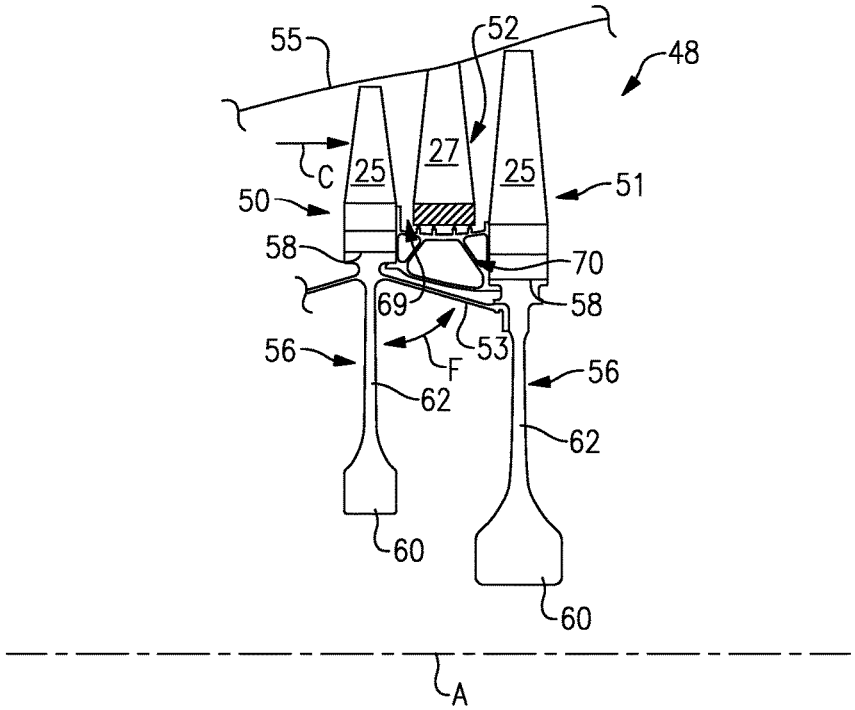
FIG. 2 illustrates a cross-sectional view of a portion of a gas turbine engine.

FIG. 2 illustrates a segment of a rotor/stator assembly 48 of a gas turbine engine, such as the gas turbine engine 20 of FIG. 1. In this embodiment, the rotor/stator assembly 48 is part of a turbine section 28 of the gas turbine engine 20. For example, the rotor/stator assembly 48 may represent part of the low pressure turbine 39 of the gas turbine engine 20. However, this disclosure is not limited to these particular sections, and the various features of this disclosure could extend to other sections of the gas turbine engine 20, including but not limited to the compressor section 24. Also, the rotor/stator assembly 48 is not necessarily drawn to scale and has been enlarged to better illustrate its various features and components.

In one embodiment, the rotor/stator assembly 48 includes a first rotor assembly 50, a second rotor assembly 51, and a stator assembly 52 axially intermediate of the first rotor assembly 50 and the second rotor assembly 51. The first rotor assembly 50, the second rotor assembly 51 and the stator assembly 52 are each circumferentially disposed about the engine centerline longitudinal axis A. The first and second rotor assemblies 50, 51 are rotating structures that carry one or more blades 25, while the stator assembly 52 is a stationary structure having one or more stators 27. Of course, additional stages of rotor and stator assemblies may be employed within the rotor/stator assembly 48. A support member 53 may extend between the first rotor assembly 50 and the second rotor assembly 51 such that the first and second rotor assemblies 50, 51 rotate in unison during engine operation.

The blades 25 of the first and second rotor assemblies 50, 51 are carried by rotor disks 56 that rotate about the engine centerline longitudinal axis A to move the blades 25. Each rotor disk 56 includes a rim 58, a bore 60 and a web 62 that extends between the rim 58 and the bore 60. The blades 25 extend outwardly from the rims 58 of the rotor disk 56 toward an engine casing 55.

A plurality of seal segments 70 (only one shown) may be annularly disposed in a cavity 69 that extends between the first rotor assembly 50 and the second rotor assembly 51. In one embodiment, the seal segments 70 extend radially between the stator assembly 52 and the support member 53. The seal segments 70 form an annular seal between the core flow path C and a secondary cooling flow path F radially inward from the core flow path C (that is, between the first rotor assembly 50 and the second rotor assembly 51). The secondary cooling flow path F circulates a cooling fluid, such as airflow, to cool portions of the rotor assemblies 50, 51, including but not limited to the rims 58, the bores 60, and the webs 62 of the rotor disks 56 and the blades 25.

In one embodiment, the seal segments 70 are axially disposed between the first rotor assembly 50 and the second rotor assembly 51, and biased in place by pressure exerted by flanking rotors. In this way, the seal segments 70 rotate in unison with the rotor disks 56 to seal the cavity 69 between the rotor assemblies 50, 51 and the stator assembly 52.

The seal segments 70 are made of a Gamma Titanium Aluminide alloy, in one embodiment. Other alloys or materials may alternatively be used to manufacture the seal segments 70.

Figure 3A:
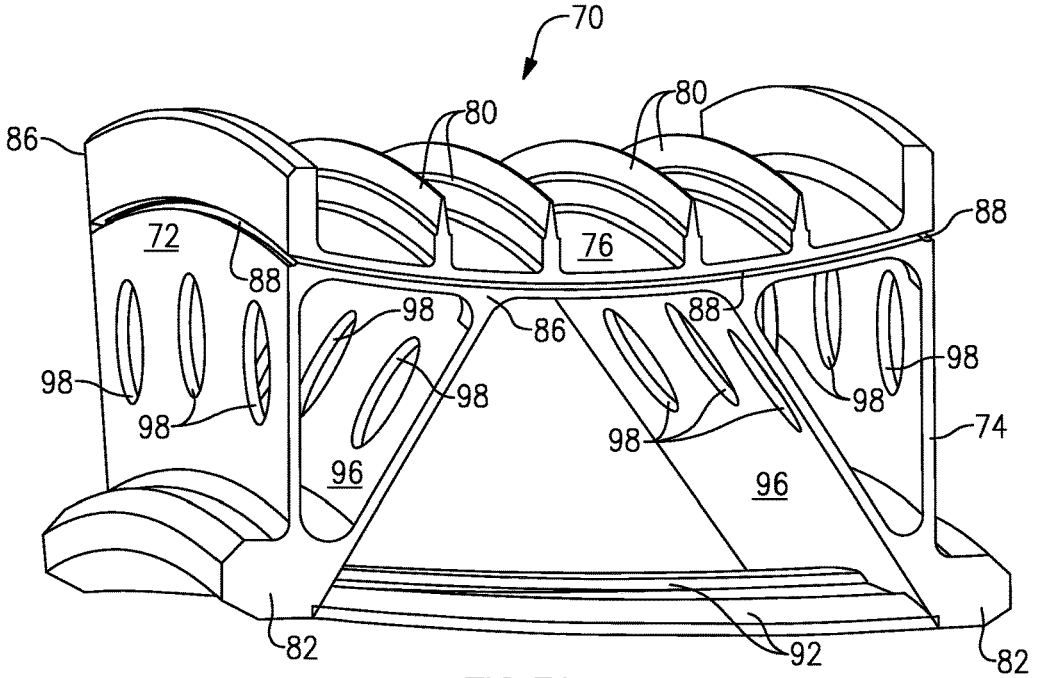
FIGS. 3A and 3B illustrate a seal segment that can be incorporated into a gas turbine engine.
Figure 3B:
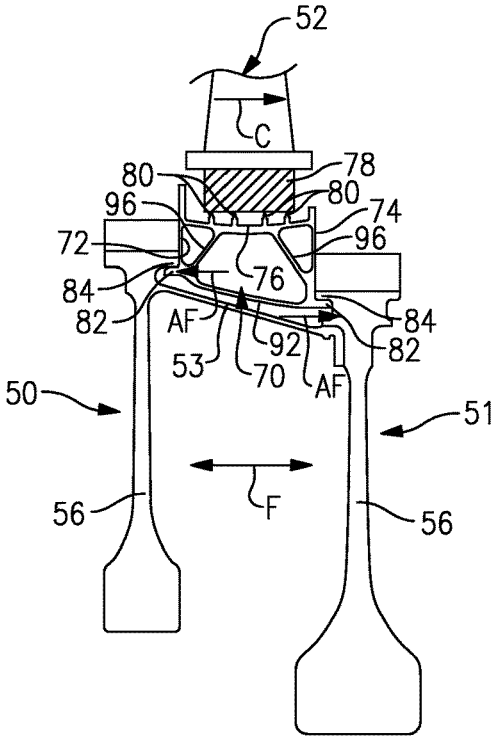

FIGS. 3A and 3B illustrate one exemplary seal segment 70 that may be incorporated into the gas turbine engine 20. The seal segment 70 includes a first axial wall 72, a second axial wall 74 spaced from the first axial wall 72, and a radially outer wall 76 that interconnects the first axial wall 72 and the second axial wall 74. In a mounted position of the seal segment 70 (shown in FIG. 3B), the first axial wall 72 is adjacent to the first rotor assembly 50, the second axial wall 74 is adjacent to the second rotor assembly 51, and the radially outer wall 76 interfaces with an abradable seal 78 of the stator assembly 52.

One or more seals 80, such as knife edge seals, may extend from the radially outer wall 76. The seals 80 circumferentially extend about the radially outer wall 76 and, in cooperation with the abradable seal 78 of the stator assembly 52, prevent core airflow of the core flow path C from bypassing the stator assembly 52.

The first axial wall 72 and the second axial wall 74 extend radially between the radially outer wall 76 and a radially inner wall 92 (discussed below) and shield various hardware, including but not limited to the rotor disks 56 and the blades 25, from the relatively hot temperatures of the core flow path C. Each of the first axial wall 72 and the second axial wall 74 may include flanges 82 that engage shelves 84 of the rotor disks 56 of the rotor assemblies 50, 51. The flanges 82 abut the shelves 84 restrain the seal segment 70 from radial movement during gas turbine engine operation.

Circumferential faces 86 (see FIG. 3A) of the seal segment 70 may include grooves 88. The grooves 88 are configured to receive a seal (not shown), such as, for example, a feather seal, wire seal, shiplap seal or any other type of seal. The seals are positioned within the grooves 88 to seal and prevent gas flow ingestion between adjacent seal segments 70. In one embodiment, the grooves 88 extend across the first axial wall 72 and the second axial wall 74.

The radially inner wall 92 of the seal segment 70, which is not a required component of the seal segment 70, is one or more curved members 92 that are radially inwardly offset from the radially outer wall 76. In one embodiment, the curved members 92 extend between the first axial wall 72 and the second axial wall 74. In another embodiment, the curved members 92 extend between the flanges 82 of the first and second axial walls 72, 74. Portions of the curved members 92 may extend radially inward of the flanges 82 as shown in FIG. 3B. The curved members 92 are non-perpendicular relative to the first axial wall 72 and the second axial wall 74.

Figure 4:
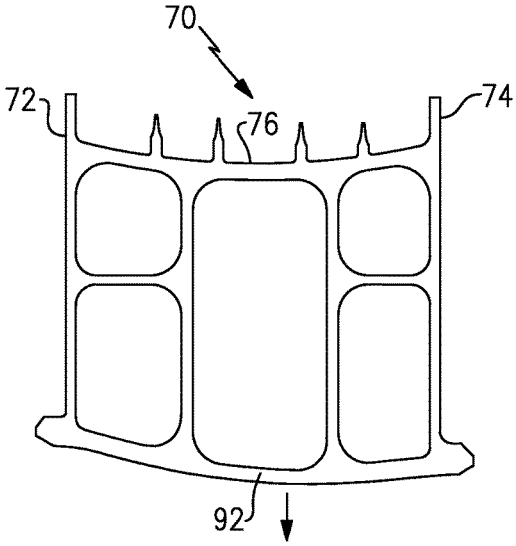
FIG. 4 illustrates another exemplary seal segment.
Figure 5:
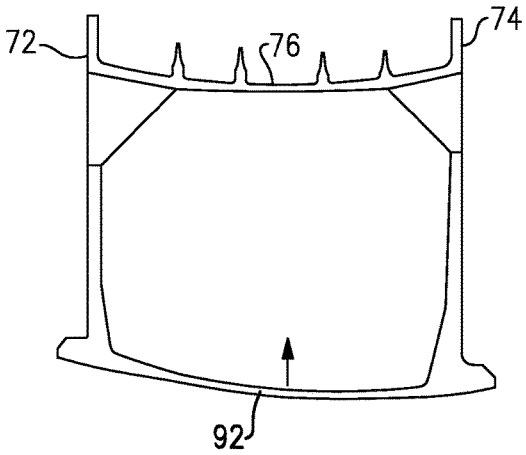
FIG. 5 illustrates yet another seal segment.

The curved members 92 extend radially outwardly from the support member 53 that axially extends between the first rotor assembly 50 and the second rotor assembly 51. In one embodiment, the curved members 92 are generally parallel to the support member 53. In another embodiment, the curved members 92 may curve in a direction away from the radially outer wall 76 (see FIG. 4). In yet another embodiment, the curved members 92 may curved in a direction toward the radially outer wall 76 (see FIG. 5). This disclosure is not intended to be limited to the exact configurations shown, and it should be understood that the curved members 92 may embody other curvatures and configurations within the scope of this disclosure.

The curved members 92 act to convey an axial force AF against the rotor disks 56. For example, during rotation of the rotor assemblies 50, 51, the curvature of the curved members 92 may exert an axial force AF which pushes the flanges 82 against the adjacent rotor disks 56 for axially retaining the segmented seal 70 between the first and second rotor assemblies 50, 51. In other words, the configuration of the seal segment 70, when disposed between rotors 50, 51, at least partially situates the curved member 92 in a state of compression.

The seal segment 70 may additionally include an internal truss established by truss segments 96 that angularly extend radially and axially between the radially outer wall 76 and the flanges 82 of the first axial wall 72 and the second axial wall 74. The truss segments 96 support the radially outer wall 76 of the seal segment 70 and may limit radial deflection of the radially outer wall 76.

One or more openings 98 may be defined through the first axial wall 72, the second axial wall 74 and the truss segments 96. Cooling airflow from the secondary cooling flow path F may circulate through the seal segment 70 via the openings 98. In one embodiment, the openings 98 provide a path for communicating the cooling airflow to cool the rims 58 of the rotor disks 56 and the blades 25.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A seal segment, comprising: a first axial wall; a second axial wall spaced from said first axial wall; a radially outer wall that interconnects said first axial wall and said second axial wall; at least one curved member radially inwardly offset from said radially outer wall and extending between said first and second axial walls, wherein said at least one curved member is configured to convey an axial force against an adjacent structure of said seal segment; and at least one truss member that extends between said radially outer wall and said at least one curved member, wherein said at least one truss member extends from the first axial wall or the second axial wall to the radial outer wall.

2. A gas turbine engine comprising said seal segment as recited in claim 1.

3. The gas turbine engine as recited in claim 2, wherein said seal segment is part of a low pressure turbine of a turbine section.

4. The seal segment as recited in claim 1, wherein said at least one curved member is curved in a direction toward said radially outer wall.

5. The seal segment as recited in claim 1, wherein said at least one curved member is curved in a direction away from said radially outer wall.

6. The seal segment as recited in claim 1, wherein said radially outer wall includes a groove that extends between said first axial wall and said second axial wall.

7. The seal segment as recited in claim 1, wherein said at least one curved member extends between flanges that protrude from said first axial wall and said second axial wall.

8. The seal segment as recited in claim 1, wherein said at least one curved member conveys an axial force against an adjacent structure of said seal segment.

9. The seal segment as recited in claim 1, wherein said at least one curved member is non-perpendicular relative to said first axial wall and said second axial wall.

10. The seal segment as recited in claim 1, comprising at least one seal extending from said radially outer wall.

11. A turbine section, comprising:

a first rotor disk;

a second rotor disk; and said seal segment of claim 1 is axially intermediate of said first rotor disk and said second rotor disk, wherein said at least one curved member is configured to convey the axial force against said first rotor disk and said second rotor disk.

12. The turbine section as recited in claim 11, comprising a stator assembly radially outward of said seal segment.

13. The turbine section as recited in claim 12, wherein said stator assembly includes an abradable seal that interfaces with a seal of said seal segment.

14. A gas turbine engine, comprising:

a first rotor assembly;

a second rotor assembly;

a stator assembly axially intermediate of said first rotor assembly and said second rotor assembly;

a plurality of seal segments disposed in a cavity defined between said first rotor assembly and said second rotor assembly, wherein each of said plurality of seal segments includes:

a first axial wall;

a second axial wall spaced from said first axial wall;

a radially outer wall that interconnects said first axial wall and said second axial wall;

at least two curved members radially offset from said radially outer wall, wherein each of said at least two curved members is configured to convey an axial force against each of said first rotor assembly and said second rotor assembly; and at least one truss member extending between said radially outer wall and said at least two curved members.

15. The gas turbine engine as recited in claim 14, wherein each of said first axial wall and said second axial wall include a flange that abuts a ledge of a rotor disk of said first rotor assembly and said second rotor assembly.

16. The gas turbine engine as recited in claim 15, wherein said at least two curved members are under an axial compressive force between said flanges.

17. The gas turbine engine as recited in claim 14, wherein each of said plurality of seal segments are made of a Gamma Titanium Aluminide alloy.

18. A gas turbine engine, comprising:

a first rotor assembly;

a second rotor assembly;

a support member connecting between said first rotor assembly and said second rotor assembly such that said first rotor assembly and said second rotor assembly rotate in unison during operation of said gas turbine engine;

a stator assembly axially intermediate of said first rotor assembly and said second rotor assembly;

a seal segment disposed radially between said stator assembly and said support member and rotating in unison with said first rotor assembly and said second rotor assembly during operation of said gas turbine engine, wherein said seal segment includes:

a first axial wall that is contiguous with said first rotor assembly and includes a first flange that engages a first shelf of said first rotor assembly;

a second axial wall spaced from said first axial wall, said second axial wall contiguous with said second rotor assembly and includes a second flange that engages a second shelf of said second rotor assembly;

a radially outer wall that interconnects said first axial wall and said second axial wall; and at least one curved member radially offset from said radially outer wall, wherein said at least one curved member is configured to exert an axial force to push said first flange against said first rotor assembly and said second flange against said second rotor assembly as said first rotor assembly and said second rotor assembly rotate in unison.

19. The gas turbine engine as recited in claim 18, wherein said first axial wall and said second axial wall are parallel to one another, and comprising a truss member that extends between said radially outer wall and said at least one curved member and is transverse to each of said first axial wall and said second axial wall.

20. The gas turbine engine as recited in claim 18, wherein said at least one curved member includes two curved members.

* * * * *